US008870031B2

(12) United States Patent
Hagleitner

(10) Patent No.: US 8,870,031 B2
(45) Date of Patent: Oct. 28, 2014

(54) DISPENSER

(71) Applicant: Hans Georg Hagleitner, Zell am See (AT)

(72) Inventor: Hans Georg Hagleitner, Zell am See (AT)

( * ) Notice: Subject to any disclaimer, the term of this patent is extended or adjusted under 35 U.S.C. 154(b) by 0 days.

(21) Appl. No.: 13/658,014

(22) Filed: Oct. 23, 2012

(65) Prior Publication Data

US 2013/0043276 A1 Feb. 21, 2013

Related U.S. Application Data

(63) Continuation of application No. PCT/AT2011/000198, filed on Apr. 21, 2011.

(30) Foreign Application Priority Data

Apr. 23, 2010 (AT) ..... A 671/2010

(51) Int. Cl.
*B67D 7/84* (2010.01)
*A47K 5/12* (2006.01)

(52) U.S. Cl.
CPC ..... *A47K 5/1208* (2013.01)
USPC ..... 222/173; 222/180; 222/181.1; 222/182; 222/212; 222/213; 222/325; 222/631

(58) Field of Classification Search
USPC ..... 222/181.1–181.3, 207, 212–215, 222/630–633, 180, 173, 325, 183
See application file for complete search history.

(56) References Cited

U.S. PATENT DOCUMENTS

| | | | | | |
|---|---|---|---|---|---|
| 2,772,817 | A | * | 12/1956 | Jauch | 222/207 |
| 3,871,559 | A | * | 3/1975 | Smith et al. | 222/183 |
| 4,085,866 | A | * | 4/1978 | Fekl | 222/158 |
| 4,130,224 | A | * | 12/1978 | Norman et al. | 222/207 |
| 4,429,812 | A | | 2/1984 | Steiner et al. | |
| 4,570,827 | A | * | 2/1986 | Roggenburg et al. | 222/95 |
| 4,673,109 | A | * | 6/1987 | Cassia | 222/153.03 |
| 4,932,624 | A | | 6/1990 | Holm | |
| 5,435,465 | A | * | 7/1995 | El-Amin | 222/108 |
| 7,025,231 | B2 | * | 4/2006 | Rutherford et al. | 222/181.3 |
| 7,540,397 | B2 | | 6/2009 | Muderlak et al. | |
| 8,596,501 | B2 | * | 12/2013 | Hagleitner | 222/207 |
| 8,783,520 | B2 | * | 7/2014 | Hagleitner | 222/207 |

FOREIGN PATENT DOCUMENTS

| | | | |
|---|---|---|---|
| EP | 0 337 968 | A1 | 10/1989 |
| WO | 2004/062450 | A1 | 7/2004 |
| WO | 2005/112724 | A1 | 12/2005 |

* cited by examiner

*Primary Examiner* — Frederick C Nicolas
(74) *Attorney, Agent, or Firm* — Laurence A. Greenberg; Werner H. Stemer; Ralph E. Locher

(57) ABSTRACT

A dispenser for a liquid or pasty media contains a replaceable container at a bottom of which a pump is mounted, and a holder for the container. The dispenser further contains a holding element having a part formed from a transparent plastic material which at least partially encloses the upper region of the container.

6 Claims, 1 Drawing Sheet

DISPENSER

CROSS-REFERENCE TO RELATED APPLICATION

This application is a continuation, under 35 U.S.C. §120, of copending international application No. PCT/AT2011/000198, filed Apr. 21, 2011, which designated the United States; this application also claims the priority, under 35 U.S.C. §119, of Austrian patent application No. AT A671/2010, filed Apr. 23, 2010; the prior applications are herewith incorporated by reference in their entireties.

BACKGROUND OF THE INVENTION

Field of the Invention

The invention relates to a dispenser for a liquid or pasty media, having an exchangeable container, on the underside of which a pump is provided, in particular in a non-releasable manner, and having a holder for the container. The holder accommodates a lower part of the container and contains a retaining element which secures an upper region of the container.

The medium which has been introduced in such a container may be of any desired type, in particular media from the sanitary or hygiene sector, for example soap, shampoo, cream, disinfectant or the like, wherein the type of medium is merely of secondary importance. It is possible for the container and pump, once emptied, to be thrown away together, and therefore a new, filled container is also accompanied by a new pump. This has the advantage that the pump does not require any maintenance.

Suitable dispensers are known in a number of embodiments, and the metering pumps have a pump chamber, of which the volume can be reduced in size, wherein two non-return valves act alternately. The pump chamber, in the rest position, is filled with the medium and—as soon as the pump is actuated—a portion is pushed out through the lower non-return valve, whereas the upper valve prevents return into the container. If the actuating element is reset, then the lower valve closes and prevents air from entering, whereas the upper valve opens and takes the medium into the pump chamber. If the container is not compressible, then air has to be able to flow into the container, for example via an air channel between the container neck and the attached metering pump or via an air-admission opening on the upper side of the upended container, this opening being opened only once the container has been inserted.

The use of non-compressible containers makes it possible to reduce such dispensers to a minimum of basic elements since, for example, housings, which accommodate the functional elements and refill bags, are neither necessary, nor need they be provided, in addition, with coverings.

If each container is provided with a metering pump, then the dispenser is reduced to a holder with a mount for the container, it being possible for the holder to be fastened, for example, on a wall, and to an actuating element for the metering pump, it being possible for the actuating element to be moved in the holder. There may also be a need for a retaining element which acts in the upper region of the plugged-in container, so that the container is not accidentally pushed away and tilted out of the holder. Such a dispenser is described, for example, in European patent EP 337 968, corresponding to U.S. Pat. No. 4,932,624, in which the retaining element contains a wire bracket.

Such minimalist-appearance dispensers can be used, for example, in hotel rooms, wherein it may also be possible for a number of such dispensers for different products to be present one beside the other; in each case one dispenser for shower gel, for shampoo, for shaving foam, for skin cream, etc. The containers which hold the products are of identical configuration, and this gives rise to an esthetically pleasing row of products being displayed. It may be important here for the contents not to be mixed up, and therefore each container plugged into a holder should be capable of being removed as completely as possible and the contents should also be comprehensible. Herein lies a disadvantage of the known dispenser, where the retaining element which secures the upper region is formed by a wire bracket, which partially covers over the text on the container and also cannot itself, in some cases, bear any information.

SUMMARY OF THE INVENTION

In order to solve the above-identified problem, the invention proposes a dispenser in which the retaining element is provided with a part which at least partially encloses the upper region of the container and is made of a transparent plastics material, through which information which is covered over by a part can be read from the outside. The retaining element extends upward in particular from the holder, but could also be mounted directly on the wall, separately from the holder. The retaining element could then also be used without a dispenser in order for a container to be hung, as a supply, on the wall.

With the foregoing and other objects in view there is provided, in accordance with the invention a dispenser for a liquid or pasty media. The dispenser contains an exchangeable container having an underside, a pump disposed on the underside of the exchangeable container, and a holder for the exchangeable container. The holder accommodates a lower part of the exchangeable container. A retaining element secures an upper region of the exchangeable container. The retaining element has a part which at least partially encloses the upper region of the exchangeable container and is made of a transparent plastic material, through which information which is covered over by the part is visible from an outside.

Forming the retaining element from a transparent plastics material means that it is always possible to read the covered-over container region, and therefore it is no longer necessary for the retaining element to be produced in as small a size as possible, as is customary in the case of a wire bracket. A retaining element made of transparent plastics material may be of wider or higher configuration, without adversely affecting the ability to read the text on the container, and thus also allows advantageous cross-sectional surface areas to be selected. It is thus possible, for example, for the retaining element to be configured as a ring with a rectangular or similarly flat cross-sectional surface area and thus also itself to be used as an information carrier, if the latter is applied to the inner surface. The information could contain, for example, multilingual details regarding the type of medium held in the container, and could possibly also bear the hotel's own advertising material.

It is preferable for this information to be provided on a carrier, in particular an adhesive label, which adheres to the inner surface of the plastics-material part which secures the container, wherein the information is also safeguarded against contact and becoming dirty.

In accordance with an added feature of the invention, the retaining element extends upward from the holder.

In accordance with another feature of the invention, information which is visible from the outside is provided on an inner surface of the part.

In accordance with a further feature of the invention, a carrier adheres to an inner surface of the part, the information being applied to the carrier.

In accordance with an additional feature of the invention, the part is a ring and the ring has a rectangular cross-sectional surface area.

In accordance with a concomitant feature of the invention, the pump is disposed on the underside of the exchangeable container in a non-releasable manner.

Other features which are considered as characteristic for the invention are set forth in the appended claims.

Although the invention is illustrated and described herein as embodied in a dispenser, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
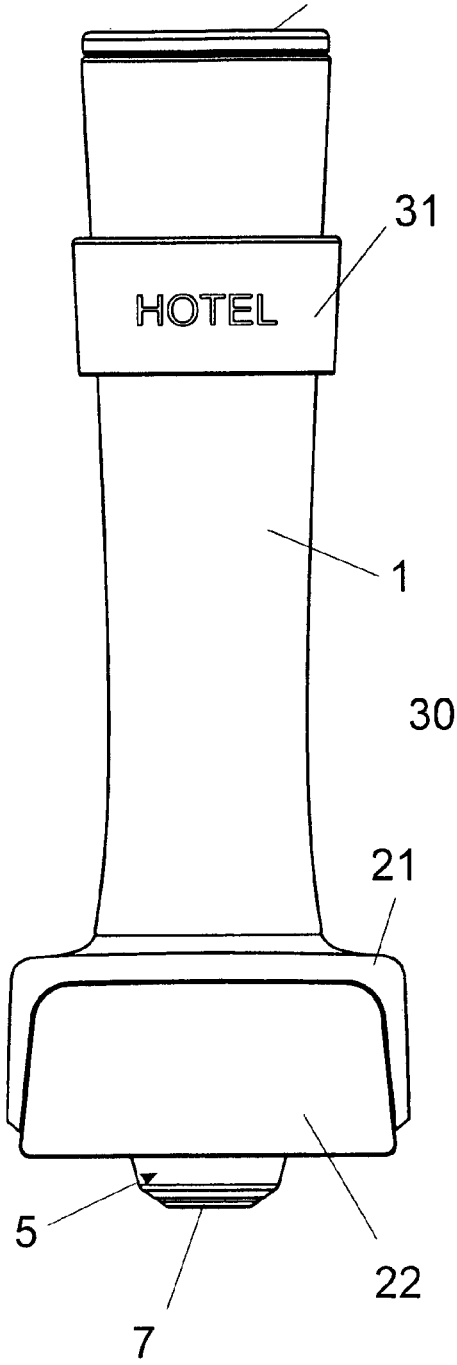
FIG. 1 is a diagrammatic, front view of a dispenser with a container inserted according to the invention.
Figure 2:
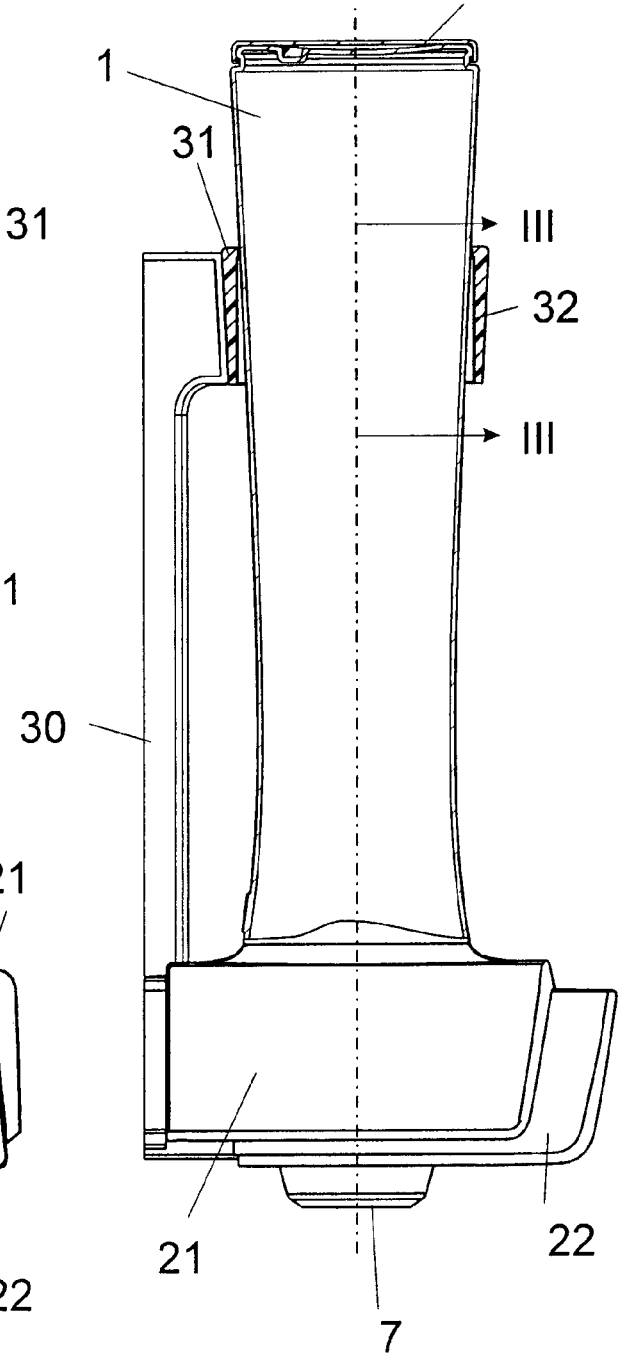
FIG. 2 is a side view of the dispenser from FIG. 1, partly in section.

Referring now to the figures of the drawing in detail and first, particularly, to FIG. 1 thereof, there is shown a refill unit for a dispenser for dispensing a liquid or pasty medium. The refill unit contains a stiff container 1 which can have air admitted to it and has a neck, on which a metering pump 5 is arranged and which is inserted in an upended state into a holder 21, and therefore a dispensing opening 7 of the metering pump 5 is at the bottom.

In the holder 21, a drawer-like actuating element 22 for the metering pump 5 can be displaced horizontally in relation to a spring, wherein the actuating element 22 extends more or less over the entire width and height of the holder 21, as can be seen from FIG. 1.

Figure 3:
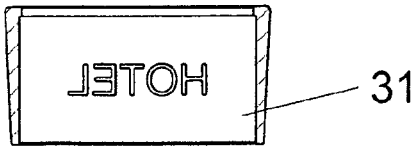
FIG. 3 is a sectional view take along the line III-III shown in FIG. 2, without the container.

A side support 30 extends upward from the holder 21, and has an upper ring 31 arranged on it, the upper ring 31 additionally securing the container 1 in an upper region against being accidentally pushed away or tilted. The upper ring 31 has, in particular, an approximately rectangular cross section and consists of a transparent plastics material, and therefore it is possible for information, for example on a stick-on carrier 32, to be applied to the inner side of the ring 31 so as to be safeguarded against external contact. FIG. 3 shows this schematically and, on account of the viewing direction, in mirror writing.

On the upper side, the container 1 may have a covering 37, beneath which it is also possible to provide an air-admission opening. Once the container 1 has been inserted into the holder 21, the covering 37 can be plugged on, wherein the air-admission opening is pierced.

The invention claimed is:

1. A dispenser for a liquid or pasty media, the dispenser comprising:

an exchangeable stiff container having an underside, said container configured for having air admitted therein;

a pump disposed on said underside of said exchangeable container;

a holder for said exchangeable container, said holder only accommodating a lower part including said underside of said exchangeable container and said pump; and a retaining element securing an upper region of said exchangeable container, said retaining element extending upward from said holder, said retaining element having a ring for enclosing said upper region of said exchangeable container and being made of a transparent plastic material, through which information which is covered over by said ring is visible from an outside, the information being provided on a substrate selected from a group consisting of an outer surface of said container, an inner surface of said ring, and a carrier adhering to said inner surface of said ring.

2. The dispenser according to claim 1, wherein said ring has a rectangular cross-sectional surface area.

3. The dispenser according to claim 1, wherein said pump is disposed on said underside of said exchangeable container in a non-releasable manner.

4. The dispenser according to claim 1, wherein said retaining element has a width in a region between said ring and said lower part, said width being less than a width of said container along said region between said ring and said lower part.

5. A dispenser for a liquid or pasty media, the dispenser comprising:

an exchangeable container having an underside;

a pump disposed on said underside of said exchangeable container;

a holder for said exchangeable container, said holder accommodating a lower part of said exchangeable container;

a retaining element securing an upper region of said exchangeable container, said retaining element extending upward from said holder, said retaining element having a part which at least partially encloses said upper region of said exchangeable container and being made of a transparent plastic material, through which information which is covered over by said part is visible from an outside, the information which is visible from the outside is provided at an inner surface of said part; and a carrier adhering to an inner surface of said part, the information being applied to said carrier.

6. The dispenser according to claim 5, wherein said part is a ring.

* * * * *